United States Patent [19]

Dacal

[11] Patent Number: 4,735,810

[45] Date of Patent: Apr. 5, 1988

[54] COFFEE INFUSION BAG

[76] Inventor: Manuel G. Dacal, c/o Cafecol Trading Corp., P.O. Box 441162, Miami, Fla. 33144

[21] Appl. No.: 928,244

[22] Filed: Nov. 7, 1986

[51] Int. Cl.[4] ..... B65D 85/00; B65B 29/04; A47G 19/16

[52] U.S. Cl. ..... 426/80; 206/0.5; 99/287; 100/123; 100/211; 100/234; 426/83; 426/466; 426/595

[58] Field of Search ..... 426/77–84; 206/0.5; 99/287; 100/123, 211, 234

[56] References Cited

U.S. PATENT DOCUMENTS

| | | | |
|---|---|---|---|
| 2,308,241 | 1/1943 | Hogaboom | 426/80 |
| 2,406,018 | 8/1946 | Irmseher | 206/0.5 |
| 2,562,456 | 7/1951 | Gunnar | 426/82 |
| 2,606,836 | 8/1952 | McCabe | 426/83 |
| 2,614,934 | 10/1952 | Trotman | 426/83 |
| 2,728,670 | 12/1955 | Young et al. | 426/82 |
| 2,728,671 | 12/1955 | Young et al. | 426/82 |
| 2,728,672 | 12/1955 | Young et al. | 426/80 |
| 2,800,408 | 7/1957 | Fimple | 426/80 |
| 2,878,927 | 3/1959 | Haley | 426/83 |
| 2,986,269 | 5/1961 | Goldberg | 426/83 |
| 3,047,397 | 7/1962 | Irmscher | 426/80 |
| 3,057,729 | 10/1962 | Grant | 426/83 |
| 3,092,242 | 6/1963 | Irmscher | 426/80 |
| 3,237,550 | 3/1966 | Christopher | 426/80 |
| 3,342,518 | 9/1967 | Gorton | 426/82 |
| 3,370,524 | 2/1968 | Kasakoff | 426/77 |
| 3,387,978 | 6/1968 | Major | 426/80 |
| 3,539,355 | 11/1970 | Kasakoff | 426/80 |
| 3,550,528 | 12/1970 | O'Neill | 426/80 |
| 3,607,302 | 9/1971 | Beck | 426/83 |
| 4,153,153 | 5/1979 | Herzog | 426/83 |
| 4,250,990 | 2/1981 | Casper | 426/80 |

FOREIGN PATENT DOCUMENTS

| | | | |
|---|---|---|---|
| 2032166 | 1/1972 | Fed. Rep. of Germany | 426/77 |
| 2323052 | 11/1974 | Fed. Rep. of Germany | 426/77 |

*Primary Examiner*—Steven Weinstein
*Attorney, Agent, or Firm*—Richard L. Miller

[57] ABSTRACT

A filter bag containing a quantity of finely grounded coffee beans, the bag being attached by a string to a tag so that the bag can be dipped in a cup of boiling water so to make a coffee beverage.

5 Claims, 1 Drawing Sheet

COFFEE INFUSION BAG

BACKGROUND OF THE INVENTION

This invention relates generally to a bag for being dipped in a cup of hot water, the bag containing an ingredient for making the water into a pleasant beverage, similarly as a tea bag makes a cup of tea. More specifically it relates to a coffee bag for making a quick cup of coffee.

It is well known that a quick cup of coffee may be produced now-a-day by putting conventional instant, freeze dried coffee in a cup of hot water. This coffee comprises ground up crystals derived from a brew of the coffee; a spoonful of the crystals then being dissolved in the cup of hot water so as to form the beverage. However, persons who are fond of drinking coffee are aware that such instant coffee is not as tasty as slowly brewed coffee that is made directly from the coffee beans. Thus there is a need at this time for a fast made cup of coffee having the taste quality of slow brewed coffee.

SUMMARY OF THE INVENTION

Accordingly it is a principal object of the present invention to provide a process for making a fast coffee and a bag into which it is placed for being dipped into a coffee cup to quickly make a tastier coffee beverage.

Another object is to provide a process for making a fast coffee bag which prevents loose coffee grounds from floating freely throughout the beverage.

Yet another object is to provide an article of manufacture and a process for making a fast coffee bag which is an improvement over those that have been developed in the past such as are shown in the U.S. Pat. Nos. 3,175,911 to Rambold, 3,384,492 to Spencer and 3,607,302 to Beck.

Other objects are to provide an article and a process for making a fast coffee bag which is simple, inexpensive to manufacture and practical in use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Figure 1:
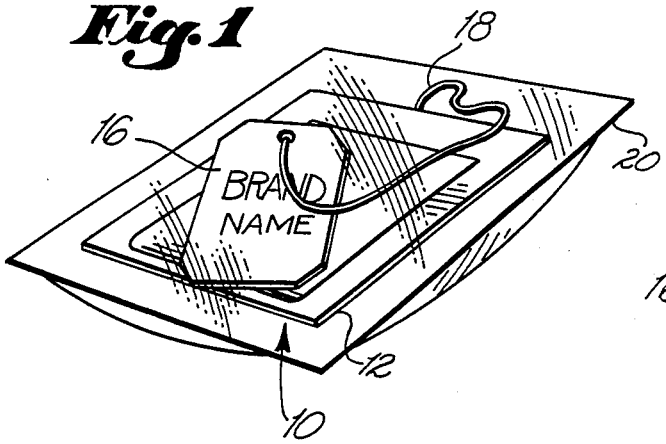
FIG. 1 is a perspective view of a fast coffee bag shown sealed inside an envelope for protection prior to use.
Figure 2:
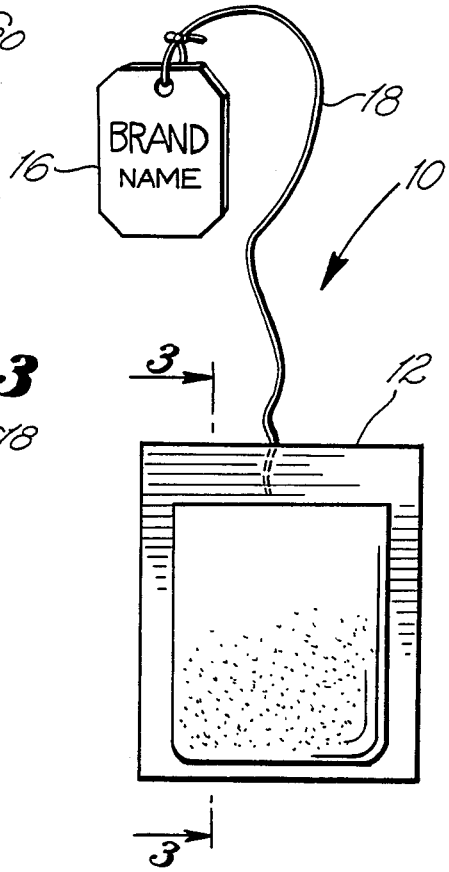
FIG. 2 is a front elevational view thereof showing the bag removed from the protective envelope.
Figure 3:
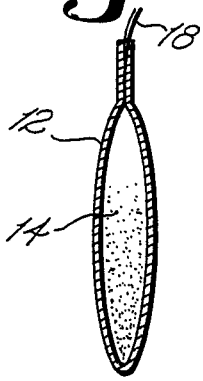
FIG. 3 is a side cross sectional view taken on line 3—3 of FIG. 2.

Referring now to the Drawing in greater detail, and more particularly to FIGS. 1 through 3 thereof at this time, the reference numeral 10 represents a fast coffee bag according to the present invention, wherein there is a thermoseal filter paper bag 12 containing a quantity of ground coffee 14. A name tag 16 is attached to the bag by means of a string 18, and the coffee bag 10, thus manufactured is sealed inside a polyethylene plastic pouch or envelope 20 so as to conserve the product's aroma and flavor prior to being used for making a cup of beverage to drink.

The ground coffee 14 is made by the following process:

Open coffee beans are selected to obtain supreme quality. The coffee beans are then roasted at various temperatures to completely extract all moisture content from the beans so as to assure the best flavor and aroma. The process begins at temperature of 140° F. The beans are then roasted at 180° F. and finally at 220° F., leaving the beans completely roasted. There is a thirty minute interval between such roasting. After the roasting process is completed, the coffee beans are taken to a temperature of 45° F. so as to conserve their aroma and quality. This process takes forty eight hours. After being thus processed, the beans are then finely ground and packaged in the bags 12. Each bag receives 1½ to 2 grams of the coffee.

The bag openings are then sealed closed together with one end of the string 18 having been first inserted therein, and the name tag 16 attached to the other end of the string. A brand name may be printed on the bag, as shown.

To obtain such a cup of coffee, the coffee bag 10 is removed from the protective envelope 20 and is then dipped repeatedly into a six and one-half ounce coffee cup containing boiling water, and stirred until the desired coffee richness is obtained. The coffee bag is then removed and discarded, leaving a clear brew with no loose coffee grounds floating in the beverage. The beverage thus made directly from coffee beans is superior in aroma and taste to beverage made from conventional instant coffee crystals.

Figure 4:
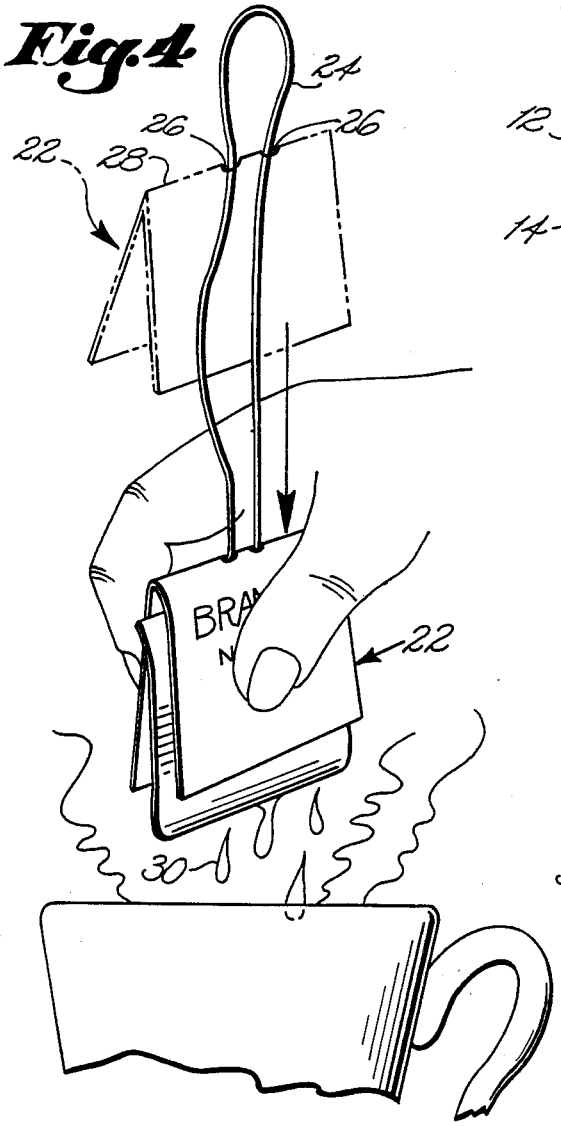
FIG. 4 is a perspective view of the invention shown including a modified design of the name tag that is used to squeeze coffee flavored water drops out of the bag.

Referring now to FIG. 4, a modified design of tag 22 is shown attached to the coffee bag 10 by means of a looped string 24 passed through a pair of holes 26 along a central fold 28 made across the tag, so that the tag can be slided on the string from the position shown in phantom lines to the position shown in solid lines wherein it is used to squeeze the bag between a person's fingers so as to extract all the drops of liquid 30 out of the bag.

The bag accordingly is preferably made of a smooth-surfaced cardboard that will not absorb the liquid and which will insulate the fingers from the steaming hot bag.

Figure 5:
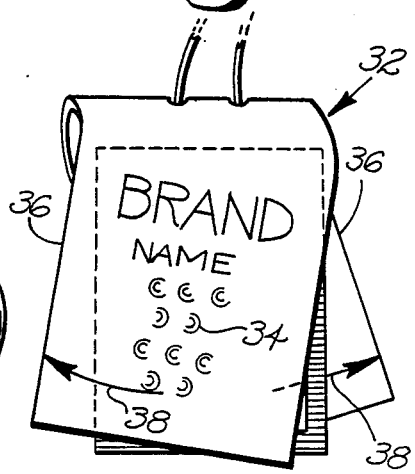
FIG. 5 is a side view showing a further modified design of the name tag.
Figure 6:
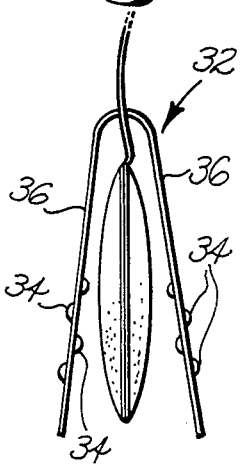
FIG. 6 is an edge end view thereof.

In FIGS. 5 and 6, a further modified design of tag 32 has a plurality of pointed protrusions 34 on each side of each of the tab panels 36 so as to functionally hold against a person's fingers and also against opposite sides of the bag, thus permitting the bag to be additionally rolled while being squeezed so as to more thoroughly extract all the liquid drops. In this design, the central fold is rounded instead being sharp bent as shown in FIG. 4, so that the panels are slidable sidewardly respective to each other, as shown by arrows 38 in FIG. 5, in order to roll the bag.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A coffee bag comprising in combination: an infusion bag made of thermoseal filter paper capable of allowing water to filter therethrough; a quantity of ground coffee beans sealed inside said bag; an inverted U-shaped string attached to said bag and having two legs, an interconnected bight portion, and bottom free ends of the legs attached to said bag; an inverted U-shaped folded tag comprising a pair of opposing panels interconnected along a fold and having a pair of spaced apart holes along the fold with each leg of the string passing through a hole respectively such that the tag can be slid on the string from its bight portion downward onto the bag such that the panels may be used to squeeze the bag therebetween to extract infusion liquid from the bag; said panels further including a plurality of protrusions on each side of each of said panels sufficient to functionally hold against a person's fingers and also hold the panels against opposite sides of the bag thus permitting the bag to be additionally rolled while being squeezed so as to more thoroughly extract infusion liquid from the bag.

2. The combination as set forth in claim 1, wherein said bag is made of a size to fit into a coffee cup.

3. The combination as set forth in claim 2, wherein said coffee beans quantity comprises from 1½ to 2 grams to make a coffee beverage from boiling water poured into said cup.

4. The combination as set forth in claim 3, wherein said cup is of six and one-half ounce size.

5. The combination as set forth in claim 1, wherein the fold is rounded such that said panels are slidable sidewardly respective to each other sufficient to roll said bag.

* * * * *